US006157907A

United States Patent [19]

Taori et al.

[11] Patent Number: 6,157,907

[45] **Date of Patent: *Dec. 5, 2000**

[54] INTERPOLATION IN A SPEECH DECODER OF A TRANSMISSION SYSTEM ON THE BASIS OF TRANSFORMED RECEIVED PREDICTION PARAMETERS

[75] Inventors: Rakesh Taori; Andreas J. Gerrits, both of Eindhoven, Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/018,980

[22] Filed: Feb. 5, 1998

[30] Foreign Application Priority Data

Feb. 10, 1997 [EP] European Pat. Off. ..... 97200359

[51] Int. Cl.[7] ..... G10L 19/06

[52] U.S. Cl. ..... 704/221; 704/265

[58] Field of Search ..... 704/221, 222, 704/265, 223

[56] References Cited

U.S. PATENT DOCUMENTS

| | | | |
|---|---|---|---|
| 4,975,956 | 12/1990 | Liu et al. | 704/219 |
| 5,557,705 | 9/1996 | Taguchi | 704/219 |
| 5,664,055 | 9/1997 | Kroon | 704/223 |
| 5,675,701 | 10/1997 | Kleijn et al. | 704/222 |
| 5,737,484 | 4/1998 | Ozawa | 704/219 |
| 5,826,221 | 10/1998 | Aoyagi | 704/200 |
| 5,864,796 | 1/1999 | Inoue et al. | 704/219 |

FOREIGN PATENT DOCUMENTS

| | | | |
|---|---|---|---|
| 2174015 | 10/1996 | Canada | H03M 7/30 |

OTHER PUBLICATIONS

By K.K. Paliwal et al, "Efficient Vector Quantization of LPC Parameters at 24 Bits/Frame" IEE Transactions on Speech and Audio Processing, vol. 1, No. 1, Jan. 1993, pp. 3–14.

GSM Recommendation 06.10, GSM Full Rate Speech Transcoding Published by European Telecommunication Standardisation Institute (ETSI) Jan. 1992.

*Primary Examiner*—David R. Hudspeth
*Assistant Examiner*—Donald L. Storm

[57] ABSTRACT

A transmission system wherein a speech signal is represented by a plurality of prediction parameters updated once per frame. Each frame comprises a plurality of sub-frames in which an excitation signal generated by a fixed codebook and an adaptive codebook is updated. In order to enhance the reconstructed speech quality the prediction coefficients are interpolated at the decoder by an LPC coefficient interpolator to obtain interpolated prediction coefficients for each sub-frame. According to the present invention the interpolation of the prediction coefficients is not based on the prediction coefficients used for transmission, such as reflection coefficients or Log Area Ratios, but on Line Spectral Frequencies. This reduces degradation of speech quality due to interpolation.

15 Claims, 3 Drawing Sheets

INTERPOLATION IN A SPEECH DECODER OF A TRANSMISSION SYSTEM ON THE BASIS OF TRANSFORMED RECEIVED PREDICTION PARAMETERS

BACKGROUND OF THE INVENTION

1. Field of the Invention

The present invention is related to a transmission system comprising a transmitter having a speech encoder comprising means for deriving from an input signal a symbol sequence including a representation of a plurality of prediction coefficients and a representation of an excitation signal, said transmitter being coupled via a transmission medium to a receiver with a speech decoder.

The present invention is also related to a receiver, a decoder and a decoding method.

2. Description of the Related Art

A transmission system with a speech encoder and a speech decoder is known from GSM recommendation 06.10, GSM full rate speech transcoding published by European Telecommunication Standardisation Institute (ETSI) January 1992.

Such transmission systems can be used for transmission of speech signals via a transmission medium such as a radio channel, a coaxial cable or an optical fibre. Such transmission systems can also be used for recording of speech signals on a recording medium such as a magnetic tape or disc. Possible applications are automatic answering machines or dictation machines.

In modern speech transmission system, the speech signals to be transmitted are often coded using the analysis by synthesis technique. In this technique, a synthetic signal is generated by means of a synthesis filter which is excited by a plurality of excitation sequences. The synthetic speech signal is determined for a plurality of excitation sequences, and an error signal representing the error between the synthetic signal, and a target signal derived from the input signal is determined. The excitation sequence resulting in the smallest error is selected and transmitted in coded form to the receiver.

The properties of the synthesis filter are derived from characteristic features of the input signal by analysis means. In general, the analysis coefficients, often in the form of so-called prediction coefficients, are derived from the input signal. These prediction coefficients are regularly updated to cope with the changing properties of the input signal. The prediction coefficients are also transmitted to the receiver. In the receiver, the excitation sequence is recovered, and a synthetic signal is generated by applying the excitation sequence to a synthesis filter. This synthetic signal is a replica of the input signal of the transmitter.

Often the prediction coefficients are updated once per frame of samples of the speech signal, whereas the excitation signal is represented by a plurality of sub-frames comprising excitation sequences. Mostly, an integer number of sub-frames fits in one update period of the prediction coefficients. In order to improve the quality of the signal synthesised at the receiver, in known transmission system the interpolated analysis coefficients are calculated for each excitation sequence.

A second reason for using interpolation is in case one set of analysis parameters is received in error. An approximation of said erroneously received set of analysis parameters can be obtained by interpolating the level numbers of the previous set analysis parameters and the next set of analysis parameters.

Using interpolation results always in a small degradation of the speech quality when compared with a situation in which no interpolation is required because updated prediction parameters are available for each sub-frame.

SUMMARY OF THE INVENTION

The object of the present invention is to provide a transmission system according to the preamble in which degradation of the reconstructed speech signal due to interpolation is reduced.

Therefor the communication network is characterized in that the speech decoder comprises transformation means for deriving a transformed representation of said plurality of prediction coefficients more suitable for interpolation, in that the speech decoder comprises interpolation means for deriving interpolated prediction coefficients from the transformed representation of the prediction parameters, and in that the decoder is arranged for reconstructing a speech signal on basis of the interpolated prediction coefficients.

It has turned out that some representations of the prediction coefficients are more suitable for interpolation than other representations of prediction coefficients. Types of representations of prediction coefficients that are suitable for interpolation have the property that small deviation of individual coefficients have only a small effect on speech quality.

An embodiment of the invention is characterized in that the interpolation means are arranged for deriving in dependence of a control signal, the interpolated prediction coefficients from the representation of the prediction coefficients or for deriving the interpolated prediction coefficients from the transformed representation of the prediction coefficients.

In general, the use of a transformed representation of the prediction coefficients will result in an additional computational complexity of the decoder. By choosing the type of interpolation in dependence of a control signal, it is possible to adapt the computational complexity if required. This can be useful if the speech decoder is implemented on a programmable processor which has also to perform other tasks, such like audio and/or video encoding. In such a case the complexity of the speech decoding can temporarily be decreased at the cost of some loss of speech quality, to free resources required for the other tasks.

A further embodiment of the invention is characterized in said transformed representation of prediction parameters is based on line spectral frequencies.

Line spectral frequencies have the property that an error in a particular line spectral frequency only has a major influence on a small frequency range in the spectrum of the reconstructed speech signal, making them very suitable for interpolation.

BRIEF DESCRIPTION OF THE DRAWINGS

The present invention will now be explained with reference to the drawings, wherein.

DESCRIPTION OF THE PREFERRED EMBODIMENTS

Figure 1:
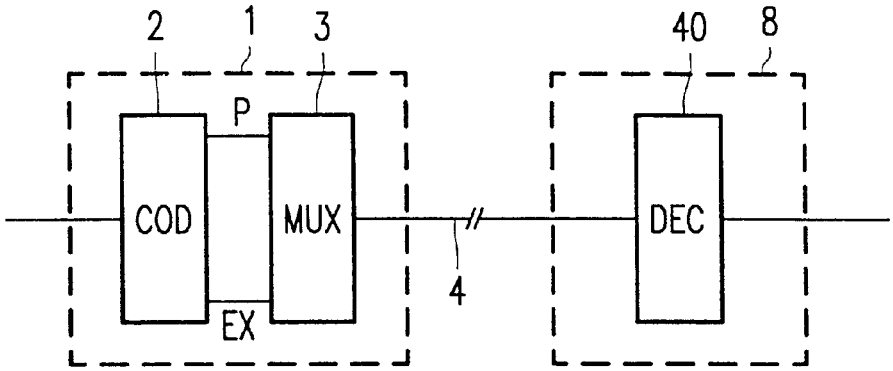
FIG. 1 shows a transmission system in which the present invention can be used.

In the communication system according to FIG. 1, a transmitter 1 is coupled to a receiver 8 via a transmission medium 4. The input of the transmitter 1 is connected to an input of a speech coder 2. A first output of the speech coder 2, carrying a signal P representing the prediction coefficients is connected to a first input of a multiplexer 3. A second output of the speech coder 2, carrying a signal EX representing the excitation signal, is connected to a second input of the multiplexer 3. The output of the multiplexer 3 is coupled to the output of the transmitter 1.

The output of the transmitter 1 is connected via the transmission medium 4 to a speech decoder 40 in a receiver 8.

In the explanation of the transmission system according to FIG. 1, it is assumed that the speech encoder 2 is arranged for encoding frames comprising a plurality of samples of the input speech signal. In the speech coder once per frame a number of prediction coefficients representing the short term spectrum of the speech signal is calculated from the speech signal. The prediction coefficients can have various representations. The most basic representations are so-called a-parameters. The a-parameters a[i] are determined by minimizing an error signal E according to:

$$E = \sum_{n=1}^{N}\left(s(n) - \sum_{i=1}^{P} a[i]s(n-i)\right)^2 \tag{1}$$

In (1) s(n) represents the speech samples, N represents the number of samples in a speech frame, P represents the prediction order, and i and n are running parameters. Normally a-parameters are not transmitted because they are very sensitive for quantization errors. An improvement of this aspect can be obtained by using so-called reflection coefficients or derivatives thereof such as log area ratios and the inverse sine transform. The reflection coefficients $r_k$ can be determined from the a-parameters according to the following recursion:

$$\left.\begin{aligned} \alpha[i] &= a[i] \\ r[i] &= \alpha^{(i)}[i] \\ \alpha^{(i-1)}[m] &= \frac{\alpha^{(i)}[m] + r[i]\cdot\alpha^{(i-1)}[i-m]}{1 - r[i]^2};\ m = 1, \ldots, i-1 \end{aligned}\right\} i = P, P-1, \ldots 2, 1 \tag{2}$$

The log-area ratios and the inverse sine transform are respectively defined as:

$$LAR[i] = \ln\left(\frac{1 - r[i]}{1 + r[i]}\right) \tag{3}$$

and $$g[i] = \sin^{-1}(r[i]) \tag{4}$$

The above mentioned representations of prediction coefficients are well known to those skilled in the art. The representation P of the prediction coefficients is available at the first output of the speech coder.

Besides the representation of the prediction coefficients, the speech coder provides a signal EX representation of the excitation signal. For the explanation of the present invention it will be assumed that the excitation signal is represented by codebook indices and associated codebook gains of a fixed and an adaptive codebook, but it is observed that the scope of the present invention is not restricted to such type of excitation signals. Consequently the excitation signal is formed by a sum of codebook entries weighted with their respective gain factors. These codebook entries and gain factors are found by an analysis by synthesis method.

The representation of the prediction signal and the representation of the excitation signal is multiplexed by the multiplexer 3 and subsequently transmitted via the transmission medium 4 to the receiver 8.

Figure 2:
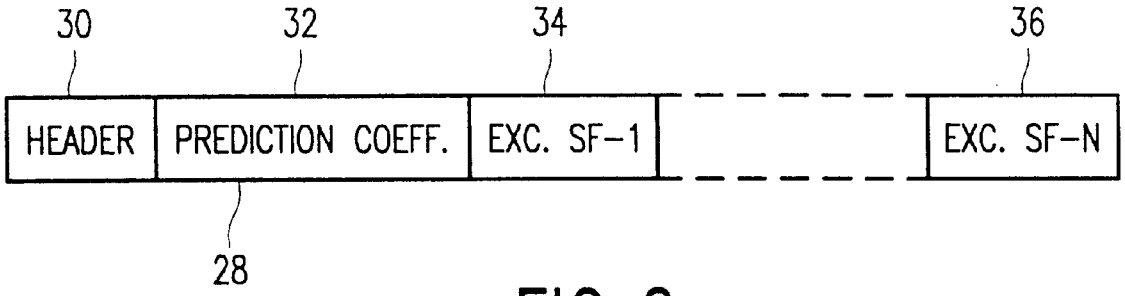
FIG. 2 shows the constitution of a frame comprising symbols representing the speech signal.
Figure 3:
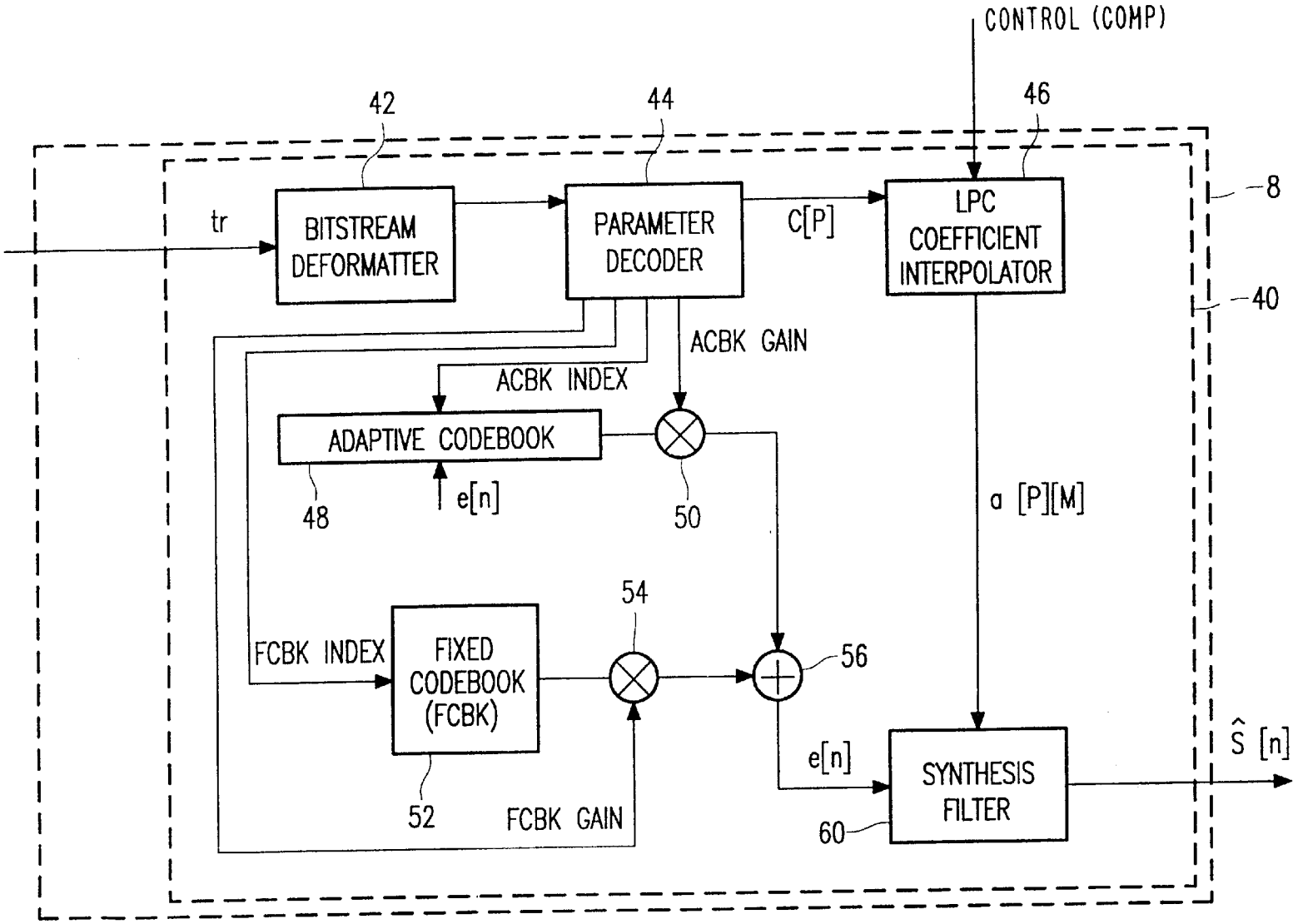
FIG. 3 is a block diagram of a receiver to be used in a network according to the invention.

The frame 28 according to FIG. 2 comprises a header 30 for transmitting e.g. a frame synchronization word. The part 32 represents the prediction parameters. The portions 34 . . . 36 in the frame represent the excitation signal. Because in a CELP coder the frame of signal samples can be subdivided in M sub-frames each with its own excitation signal, M portions are present in the frame to represent the excitation signal for the complete frame.

In the receiver 8, the input signal is applied to an input of a decoder 40. In the decoder 40, outputs of a bitstream deformatter 42 are connected to corresponding inputs of a parameter decoder 44. A first output of the parameter decoder 44, carrying an output signal C[P] representing P prediction parameters is connected to an input of an LPC coefficient interpolator 46. A second output of the parameter decoder 44, carrying a signal FCBK INDEX representing the fixed codebook index is connected to an input of a fixed codebook 52. A third output of the parameter decoder 44, carrying a signal FCBK GAIN representing the fixed codebook gain, is connected to a first input of a multiplier 54. A fourth output of the parameter decoder 44, carrying a signal ACBK INDEX representing the adaptive codebook index, is connected to an input of an adaptive codebook 48. A fifth output of the parameter decoder 44, carrying a signal ACBK GAIN representing the adaptive codebook gain, is connected to a first input of a multiplier 54.

An output of the adaptive codebook 48 is connected to a second input of the multiplier 50, and an output of the fixed codebook 52 is connected to a second input of the multiplier 54. An output of the multiplier 50 is connected to a first input of an adder 56, and an output of the multiplier 54 is connected to a second input of the adder 56. An output of the adder 56, carrying signal e[n], is connected to a first input of a synthesis filter 60, and to an input of the adaptive codebook 48.

A control signal COMP indicating the type of interpolation to be performed is connected to a control input of the LPC coefficient interpolator 46. An output of the LPC coefficient interpolator 46, carrying a signal a[P][M] representing the a-parameters, is connected to a second input of the synthesis filter 60. At the output of the synthesis filter 60 the reconstructed speech signal ŝ[n] is available.

In the receiver 8 the bitstream at the input of the decoder 40 is disassembled by the deformatter 42. The available prediction coefficients are extracted from the bitstream and passed to the LPC coefficient interpolator 46. The LPC coefficient interpolator determines for each of the subframes interpolated a-parameters a[m][i]. The operation of the LPC coefficient interpolator will be explained later in more detail.

The synthesis filter 60 calculated the output signal ŝ[n] according to:

$$\hat{s}[n] = e[n] + \sum_{i=0}^{P-1} a[m][i] \cdot \hat{s}[n-i] \tag{5}$$

In (9) e[n] is the excitation signal.

In case the number of prediction coefficients passed to the parameter decoder is less than P due to the bitrate reduction according to the invention, the value of P is substituted by a value of P' smaller than P. The calculations according to (5)–(9) are performed for P' parameters instead of P parameters. The a-parameters for use in the synthesis filter with rank larger than P' are set to 0.

The parameter decoder 44 extracts also the excitation parameters ACBK INDEX, ACBK GAIN, FCKB INDEX and FCBK GAIN for each of the subframes from the bitstream, and presents them to the respective elements of the decoder. The fixed codebook 52 presents a sequence of excitation samples for each subframe in response to the fixed codebook index (FCBK INDEX) received from the parameter decoder 44. These excitation samples are scaled by the multiplier 54 with a gain factor determined by the fixed codebook gain (FCBK GAIN) received from the parameter decoder 44. The adaptive codebook 48 presents a sequence of excitation samples for each subframe in response to the adaptive codebook index (ACBK INDEX) received from the parameter decoder 44. These excitation samples are scaled by the multiplier 50 with a gain factor determined by the adaptive codebook gain (ACBK GAIN) received from the parameter decoder 44. The output samples of the multipliers 50 and 54 are added to obtain the final excitation signal e[n] which is supplied to the synthesis filter. The excitation signal samples for each sub-frame are also shifted into the adaptive codebook, in order to provide the adaptation of said codebook.

Figure 4:
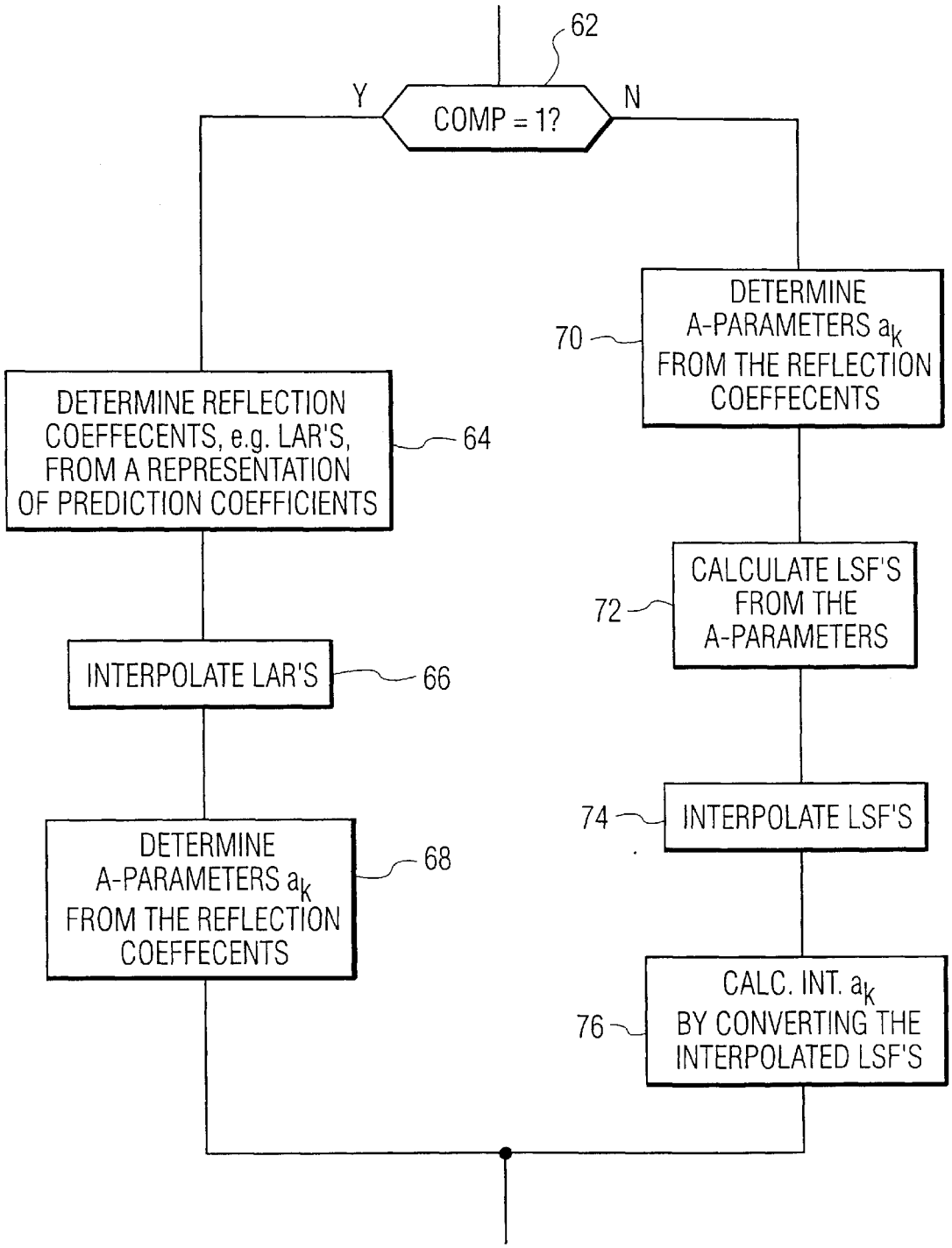
FIG. 4 is a flow graph of a program for a programmable processor for implementing the interpolator 46 of FIG. 3.

In the flow graph according to FIG. 4 the labeled blocks have the following meaning:

| No. | Inscript | Meaning |
|---|---|---|
| 62 | COMP = 1 ? | The value of the signal COMP is compared with 1 |
| 64 | DETERMINE LAR's | The LAR's are determined from the input signal. |
| 66 | INTERPOLATE LAR's | The interpolated values of the LAR's are calculated for all subframes |
| 68 | CALCULATE $a_{[i]}$ | The interpolated a-parameters are calculated for all subframes from the interpolated LAR's |
| 70 | DETERMINE $a_{[i]}$ | The a-parameters are determined from the input signal. |
| 72 | CALCULATE LSF'S | The LSF's are calculated for all subframes. |
| 74 | INTERPOLATE LSF'S | The LSF's are interpolate for all subframes. |
| 76 | CALC. INT. $a_{[i]}$ | The interpolated a-parameters are calculated for all subframes from the LSF's. |

In instruction 62, the value of the input signal is compared with the value 1. If the value of COMP is equal to 1, the interpolation to be performed will be based on LAR's. If the value of COMP differs from 1, the interpolation to be performed will be based on LSF's'. In instruction 64 first the value of the reflection coefficients $r_k$ are determined from the input signal of the C[P] of the LPC coefficient interpolator 46. This determination is based on a look up table which determines the value of a reflection coefficient in response to an index C[k] representing the $k^{th}$ reflection coefficient. To be able to use only a single table for looking up the reflection coefficients, a sub table is used to define an offset for each of the parameters C[k] representing a prediction parameter. It is assumed that a maximum of 20 prediction parameters is present in the input frames. This sub table is presented below as Table 1.

TABLE 1

| k | Offset | k | Offset |
|---|---|---|---|
| 0 | 13 | 10 | 18 |
| 1 | 0 | 11 | 17 |
| 2 | 16 | 12 | 19 |
| 3 | 12 | 13 | 17 |
| 4 | 16 | 14 | 19 |
| 5 | 13 | 15 | 18 |
| 6 | 16 | 16 | 19 |
| 7 | 14 | 17 | 17 |
| 8 | 18 | 18 | 19 |
| 9 | 16 | 19 | 18 |

For each of the received prediction parameter, the offset to be used in the main table (Table 2) is determined from table 1, by using the rank number k of the prediction coefficient as input. Subsequently the entry in table 2 is found by adding the value of Offset to the level number C[k]. Using said entry, the value corresponding reflection coefficient r[k] is read from Table 2.

TABLE 2

| C[k] + O | r[k] | C[k] + O | r[k] |
|---|---|---|---|
| 0 | −0.9896 | 25 | 0.4621 |
| 1 | −0.9866 | 26 | 0.5546 |
| 2 | −0.9828 | 27 | 0.6351 |
| 3 | −0.9780 | 28 | 0.7039 |
| 4 | −0.9719 | 29 | 0.7616 |
| 5 | −0.9640 | 30 | 0.8093 |
| 6 | −0.9540 | 31 | 0.8483 |
| 7 | −0.9414 | 32 | 0.8798 |
| 8 | −0.9253 | 33 | 0.9051 |
| 9 | −0.9051 | 34 | 0.9253 |
| 10 | −0.8798 | 35 | 0.9414 |
| 11 | −0.8483 | 36 | 0.9540 |
| 12 | −0.8093 | 37 | 0.9640 |
| 13 | −0.7616 | 38 | 0.9719 |
| 14 | −0.7039 | 39 | 0.9780 |
| 15 | −0.6351 | 40 | 0.9828 |
| 16 | 0.5546 | 41 | 0.9866 |
| 17 | −0.4621 | 42 | 0.9896 |
| 18 | 0.3584 | 43 | 0.9919 |
| 19 | −0.2449 | 44 | 0.9937 |
| 20 | −0.1244 | 45 | 0.9951 |
| 21 | 0 | 46 | 0.9961 |
| 22 | 0.1244 | 47 | 0.9970 |
| 23 | 0.2449 | 48 | 0.9977 |
| 24 | 0.3584 | | |

The set of reflection coefficients determined describes the short term spectrum for the $M^{th}$ subframe of each frame. The prediction parameters for the preceding subframes of a frame are found by interpolation between the prediction parameters for the current frame and the prediction coefficients for the previous frames.

In the case COMP has a value of 1, the interpolation is based on log area ratios. This log area ratios are determined in instruction 64 according to:

$$l_k[i] = \ln\left(\frac{1 - r_k[i]}{1 + r_k[i]}\right) \tag{6}$$

In instruction 66 the interpolation of the log area ratio's is performed for all subframes.

For subframe m of frame k, the interpolated value of the log area ratios are given by:

$$\hat{l}_k[i][m] = \frac{M - m}{M} l_{k-1}[i] + \frac{m}{M} l_k[i]; \quad 0 \le i \le P - 1;\ 1 \le m \le M - 1 \tag{7}$$

Instruction 68 starts with calculating from each interpolated log area ratio an interpolated reflection coefficient according to:

$$\hat{r}_k[i][m] = \frac{1 - e^{\hat{l}_k[i][m]}}{1 + e^{\hat{l}_k[i][m]}};\ 0 \le i \le P - 1;\ 1 \le m \le M - 1 \tag{8}$$

For m=M, $\hat{r}_k[i][m]$ needs not to be computed as it is directly available from Table 2.

Subsequently the a-parameters are derived from the reflection coefficients. The a-parameters can be derived from the reflection coefficients according to the following recursion:

$$\left.\begin{aligned} a^{(i)}[i] &= r[i] \\ a^{(i)}[m] &= a^{(i-1)}[m] + r[i] \cdot a^{i-1}[i - m];\ m = 1, \ldots, i - 1 \end{aligned}\right\} i = 1, 2 \ldots P \tag{9}$$

Finally the a-parameters $a^{(P)}[i]$ obtained by (9) are supplied to the synthesis filter 60.

If the value of COMP is not equal to 1, the interpolation will be based on Line Spectral Frequencies yielding a better interpolation at the cost of an increased computational complexity.

In instruction 70 the a-parameters are determined from the values of the reflection coefficients found by using Table 1 and Table 2 as explained above. Subsequently the a-parameters $a_{[i]}$ are calculated from the reflection coefficients using the recursion according to (9). In instruction the Line Spectral frequencies are determined from the a-parameters.

The set of a-parameters can be represented by a polynomial $A_m(z)$ given by:

$$A_m(z)=1+a_1z^{-1}+a_2z^{-2}+\ldots+a_{m-2}z^{-(m-2)}+a_{m-1}z^{-(m-1)}+a_mz \tag{10}$$

A first step in the determination of the LSF's is splitting $A_m(z)$ in two polynomials P(z) and Q(z) according to:

$$P(z)=A_m(z)+z^{-(m+1)}A_m(z^{-1}) \tag{11}$$

and $$Q(z)=A_m(z)-z^{-(m+1)}A_m(z^{-1}) \tag{12}$$

(11) and (12) can be written as:

$$P(z)=1+(a_1+a_m)z^{-1}+(a_2+a_{m-1})z^{-2}+\ldots+(a_2+a_{m-1})z^{-(m-1)} \tag{13}$$

and $$Q(z)=1+(a_1-a_m)z^{-1}+(a_2-a_{m-1})z^{-2}+\ldots-(a_2-a_{m-1})z^{-(m-1)} \tag{14}$$

In the following the coefficients of P(z) and Q(z) will be indicated as $p_1, p_2 \ldots p_{m-1}, p_m$ and $q_1, q_2 \ldots q_{m-1}, q_m$.

The polynomials P(z) and Q(z) each have m+1 zeros. It further can be proved that P(z) and Q(z) have the following properties:

- All zeros of P(z) and Q(z) are on the unit circle in the z-plane
- The zeros of P(z) and Q(z) are interlaced on the unit circle; between two zeros of P(z) there is one zero of Q(z) and vice versa. The zeros do not overlap.
- The minimum phase property of $A_m(z)$ is easily preserved when the zeros of P(z) and Q(z) are quantized. Consequently the stability of the synthesis filter with transfer function $1/A_m(z)$ is ensured.

It can easily be demonstrated that z=−1 and z=+1 is always a zero of P(z) or Q(z). These zeros were introduced by expanding the order from the polynomials from m to m+1. These zeros do not contain information about the parameters of the LPC filter. For m is even, P(z) has a zero at z=−1 and Q(z) has a zero for z=+1 and for m is odd both additional zeros +1 and −1 are in Q(z). These zeros can be divided out of the polynomials without any loss of information. By doing so polynomials P'(z) and Q'(z) can be obtained for m is even according to:

$$P'(z) = \frac{P(z)}{(1 + z^{-1})} \quad Q'(z) = \frac{Q(z)}{(1 - z^{-1})} \tag{15}$$

and for m is odd according to:

$$P'(z) = P(z) \quad Q'(z) = \frac{Q(z)}{(1 - z^{-1})(1 + z^{-1})} \tag{16}$$

For m is even P'(z) can easily be recomputed as:

$$P'(z) = 1 + \sum_{i=1}^{m} (p_i - p'_{i-1})z^{-i} \quad \text{for } m \text{ is even} \tag{17}$$

P'(z)=P(z) for m is odd

In (17) $p_{i-1}$ is calculated using $p'_i=p_i-p'_{i-1}$ with $p'_0=1$. For m is odd no recalculation of P'(z) is required at all.

Q'(z) can be recalculated as:

$$Q'(z) = 1 + \sum_{i=1}^{m} (q_i + q'_{i-1})z^{-i} \quad \text{for } m \text{ is even} \tag{18}$$

$$Q'(z) = 1 + q_1z^{-1} + \sum_{i=2}^{m-1} (q_i + q'_{i-2})z^{-i} \quad \text{for } m \text{ is odd}$$

Now the zeros of P'(z) and Q'(z) have to be determined to obtain the Line Spectral Frequencies. Because P'(z) and Q'(z) have complex poles it requires a large computational effort to find them. Because all zeros lie on the unit circle, for finding these zeros z can be replaced by $e^{j\omega}$. By using the theorem of Euler ($\cos k\omega=(e^{jk\omega}+e^{-jk\omega})/2$), P'(z) and Q'(z) can be written as:

$$P'(e^{j\omega})=2e^{-j\omega m_p}\{\cos(m_p\omega)+p'_1\cos((m_p-1)\omega+\ldots+\tfrac{1}{2}p'_{m_p}\}=2e \tag{19}$$

and $$Q'(e^{j\omega})=2e^{-j\omega m_q}\{\cos(m_q\omega)+q'_1\cos((m_q-1)\omega)+\ldots+\tfrac{1}{2}q_{m_q}\}=2e^{-j\omega m_p}\tilde{Q}(\omega) \tag{20}$$

In (19) and (20) $m_p$ and $m_q$ are equal to m/2 if m is even. $m_p$=(m+1)/2 and $m_q$=(m−1)/2 if m is odd. Now polynomials $\tilde{P}(\omega)$ and $\tilde{Q}(\omega)$ with real zeros are obtained. Searching of these zeros has to be performed by stepping with small steps through a range from 0 to $\pi$. This requires a large number of evaluations of $\tilde{P}(\omega)$ and $\tilde{Q}(\omega)$). Because $\tilde{P}(\omega)$ and $\tilde{Q}(\omega)$ comprise cosine terms, this requires a substantial amount of computations. However the evaluation of $\tilde{P}(\omega)$ and $\tilde{Q}(\omega)$ can substantially be simplified by using Chebychev polynomials. By using the mapping $x=\cos(\omega)$, $\cos(m\omega)$ can be written as:

$$\cos(m\omega))=T_m(x) \tag{21}$$

In (21) $T_m$ is the $m^{th}$ order Chebychev polynomial defined as:

$$T_0(x)=1$$
$$T_1(x)=x \tag{22}$$
$$T_m(x)=2xT_{m-1}(x)-T_{m-2}(x)$$

Using the above mentioned mapping, $\tilde{P}(x)$ and $\tilde{Q}(x)$ can be written as:

$$\tilde{P}(x)=T_{m_p}(x)+p'_1T_{m_p}-1(x)+p'_2T_{m_p}-2(x)+\ldots+p_{m_p}-1T_1(x)+p_{m_p} \tag{23}$$

$$\tilde{Q}(x)=T_{mq}(x)+q_1T_{m_q}-1(x)+q_2T_{m_q}-2(x)+\ldots+q_{m_q}-1T_1(x)+q_{m_q} \tag{24}$$

Using (22), (23) and (24), $\tilde{P}(x)$ and $\tilde{Q}(x)$ can rapidly be evaluated for any value of x. If the zeros $\tilde{P}(x)$ and $\tilde{Q}(x)$ are found, the line spectral frequencies $\omega_k$ can be found by $$\omega_k=\text{arc}\cos(x_k) \tag{25}$$

Resuming the above, the LSF's are calculated in the instruction 72 using the following steps Determination of P(z) and Q(z) according to (13) and (14).

Calculation of P'(z) and Q'(z) using (17) and (18).

Finding the roots of $\tilde{P}(x)$ and $\tilde{Q}(x)$ by stepping with small steps through a range from −1 to 1. If a sign change is found the exact position of the zero can be found by successive approximation. For evaluating $\tilde{P}(x)$ and $\tilde{Q}(x)$ for each value of x, (23), (24) and (25) are used.

Calculating the zeros $\omega_k$ using (25).

In instruction 74 the interpolated Line Spectral Frequencies are calculated according to:

$$\omega_k[i][m] = \frac{M-m}{M}\omega_{k-1}[i] + \frac{m}{M}\omega_k[i]; \quad 0 \le i \le P-1;\ 1 \le m \le M-1 \tag{26}$$

In instruction 76 the interpolated values of $\omega_k[i][m]$ are converted to a-parameters. Each value of $\omega_k$ contributes to a quadratic factor of the form $1-2\cos(\omega_i)z^{-1}+z^{-2}$. The polynomials P'(z) and Q'(z) are formed by multiplying these factors using the LSF's that come from the corresponding polynomial. For P'(z) and Q'(z) can now be written:

$$P'(z) = \prod_{i=0}^{m_p-1} (1-2\cos(\omega_{2i})z^{-1}+z^{-2}) \tag{27}$$

-continued $$Q'(z) = \prod_{i=0}^{m_p-1} (1-2\cos(\omega_{2i+1})z^{-1}+z^{-2}$$

The polynomials P(z) and Q(z) are computed by multiplying P'(z) and Q'(z) with the extra zeros z=−1 and z=+1. Finally the a-coefficients are determined by using the property:

$$A_m(z) = \frac{P(z)+Q(z)}{2} \tag{28}$$

This property can easily be verified by adding (11) and (12)

What is claimed is:

1. Transmission system comprising a transmitter with a speech encoder, said speech encoder comprising means for deriving from an input signal a symbol sequence including a representation of a plurality of prediction coefficients and a representation of an excitation signal, said representation of prediction coefficients being an untransformed representation, said transmitter being coupled via a transmission medium to a receiver with a speech decoder, said transmitter being arranged for transmitting said symbol sequence, the speech decoder comprising transformation means for deriving a transformed representation of said plurality of prediction coefficients from said untransformed representation of prediction coefficients, the speech decoder comprising interpolation means for deriving interpolated prediction coefficients from the transformed representation of the prediction coefficients, and the speech decoder being arranged for reconstructing a speech signal on basis of the interpolated prediction coefficients, said transformed representation of prediction coefficients being based on line spectral frequencies, and being more suitable for interpolation than said untransformed representation of prediction coefficients.

2. Transmission system according to claim 1, wherein the interpolation means are arranged for deriving in dependence of a control signal, the interpolated prediction coefficients from the representation of the prediction coefficients or for deriving the interpolated prediction coefficients from the transformed representation of the prediction coefficients.

3. Transmission system comprising a transmitter with a speech encoder, said speech encoder comprising means for deriving from an input signal a symbol sequence including a representation of a plurality of prediction coefficients and a representation of an excitation signal, said transmitter being coupled via a transmission medium to a receiver with a speech decoder, said transmitter being arranged for transmitting said symbol sequence, the speech decoder comprising transformation means for deriving a transformed representation of said plurality of prediction coefficients from said representation of prediction coefficients, the speech decoder comprising interpolation means for deriving interpolated prediction coefficients from the transformed representation of the prediction coefficients, and the speech decoder being arranged for reconstructing a speech signal on basis of the interpolated prediction coefficients, said transformed representation of prediction coefficients being based on line spectral frequencies, and being more suitable for interpolation than said representation of prediction coefficients, and said transformation means being arranged for determining reflection coefficients from said representation of prediction coefficients, for determining a-parameters from said reflection coefficients, and for determining said line-spectral frequencies from said a-parameters.

4. Transmission system according to claim 3, wherein said interpolation means are arranged for determining interpolated line spectral frequencies from said line-spectral frequencies, and for converting said interpolated line spectral frequencies to a-parameters.

5. Receiver for receiving a symbol sequence representing a speech signal, said symbol sequence including a representation of a plurality of prediction coefficients and a representation of an excitation signal, said representation of prediction coefficients being an untransformed representation, said receiver comprising a speech decoder for deriving a reconstructed speech signal from said symbol sequence, the speech decoder comprising transformation means for deriving a transformed representation of said plurality of prediction coefficients from said untransformed representation of prediction coefficients, the speech decoder comprising interpolation means for deriving interpolated prediction coefficients from the transformed representation of the prediction coefficients, and the speech decoder being arranged for deriving said reconstructed speech signal on basis of said interpolated prediction coefficients, said transformed representation of prediction coefficients being based on line spectral frequencies, and being more suitable for interpolation than said untransformed representation of prediction coefficients.

6. Receiver according to claim 5, wherein the interpolation means are arranged for deriving in dependence of a control signal, the interpolated prediction coefficients from the representation of the prediction coefficients or for deriving the interpolated prediction coefficients from the transformed representation of the prediction coefficients.

7. Receiver for receiving a symbol sequence representing a speech signal, said symbol sequence including a representation of a plurality of prediction coefficients and a representation of an excitation signal, said receiver comprising a speech decoder for deriving a reconstructed speech signal from said symbol sequence, the speech decoder comprising transformation means for deriving a transformed representation of said plurality of prediction from said representation of prediction coefficients, the speech decoder comprising interpolation means for deriving interpolated prediction coefficients from the transformed representation of the prediction coefficients, and the speech decoder being arranged for deriving said reconstructed speech signal on basis of said interpolated prediction coefficients, said transformed representation of prediction coefficients being based on line spectral frequencies, and being more suitable for interpolation than said representation of prediction coefficients, and said transformation means being arranged for determining reflection coefficients from said representation of prediction coefficients, for determining a-parameters from said reflection coefficients, and for determining said line-spectral frequencies from said a-parameters.

8. Receiver according to claim 7, wherein said interpolation means are arranged for determining interpolated line spectral frequencies from said line-spectral frequencies, and for converting said interpolated line spectral frequencies to a-parameters.

9. Speech decoder for deriving a reconstructed speech signal from a symbol sequence, said symbol sequence including a representation of a plurality of prediction coefficients and a representation of an excitation signal, said representation of prediction coefficients being an untransformed representation, and said symbol sequence being received from a speech encoder, the speech decoder comprising transformation means for deriving a transformed representation of said plurality of prediction coefficients from said untransformed representation of prediction coefficients, the speech decoder comprising interpolation means for deriving interpolated prediction coefficients from the transformed representation of the prediction coefficients, and the speech decoder being arranged for reconstructing a speech signal on basis of the interpolated prediction coefficients, said transformed representation of prediction coefficients being based on line spectral frequencies, and being more suitable for interpolation than said untransformed representation of prediction coefficients.

10. Speech decoder according to claim 9, wherein the interpolation means are arranged for deriving in dependence of a control signal, the interpolated prediction coefficients from the representation of the prediction coefficients or for deriving the interpolated prediction coefficients from the transformed representation of the prediction coefficients.

11. Speech decoder for deriving a reconstructed speech signal from a symbol sequence, said symbol sequence including a representation of a plurality of prediction coefficients and a representation of an excitation signal, and said symbol sequence being received from a speech encoder, the speech decoder comprising transformation means for deriving a transformed representation of said plurality of prediction coefficients from said representation of prediction coefficients, the speech decoder comprising interpolation means for deriving interpolated prediction coefficients from the transformed representation of the prediction coefficients, and the speech decoder being arranged for reconstructing a speech signal on basis of the interpolated prediction coefficients, said transformed representation of prediction coefficients being based on line spectral frequencies, and being more suitable for interpolation than said representation of prediction coefficients, and said transformation means being arranged for determining reflection coefficients from said representation of prediction coefficients, for determining a-parameters from said reflection coefficients, and for determining said line-spectral frequencies from said a-parameters.

12. Speech decoder according to claim 11, wherein said interpolation means are arranged for determining interpolated line spectral frequencies from said line-spectral frequencies, and for converting said interpolated line spectral frequencies to a-parameters.

13. A speech decoding method for deriving a reconstructed speech signal from a symbol sequence, said symbol sequence including a representation of a plurality of prediction coefficients and a representation of an excitation signal, said representation of prediction coefficients being an untransformed representation, before deriving the reconstructed speech signal receiving the symbol sequence from a speech encoder, the method comprising deriving a transformed representation of said plurality of prediction coefficients from said untransformed representation of prediction coefficients, the method comprising deriving interpolated prediction coefficients from the transformed representation of the prediction coefficients, and the method comprising reconstructing a speech signal on basis of the interpolated prediction coefficients, said transformed representation of prediction coefficients being based on line spectral frequencies, and being more suitable for interpolation than said untransformed representation of prediction coefficients.

14. A speech decoding method for deriving a reconstructed speech signal from a symbol sequence, said symbol sequence including a representation of a plurality of prediction coefficients and a representation of an excitation signal, before deriving the reconstructed speech signal receiving the symbol sequence from a speech encoder, the method comprising deriving a transformed representation of said plurality of prediction coefficients from said representation of prediction coefficients, the method comprising deriving interpolated prediction coefficients from the transformed representation of the prediction coefficients, the method comprising reconstructing a speech signal on basis of the interpolated prediction coefficients, said transformed representation of prediction coefficients being based on line spectral frequencies, and being more suitable for interpolation than said representation of prediction coefficients, and the method determining reflection coefficients from said representation of prediction coefficients, determining a-parameters from said reflection coefficients, determining said line-spectral frequencies from said a-parameters.

15. A speech decoding method according to claim 14, in said method determining interpolated line spectral frequencies from said line-spectral frequencies, and converting said interpolated line spectral frequencies to a-parameters.

* * * * *